US012751486B1

(12) United States Patent
Miller

(10) Patent No.: US 12,751,486 B1
(45) Date of Patent: Oct. 6, 2026

(54) VAPORIZING DEVICE AND METHOD

(71) Applicant: Terp Chasers Club LLC, Atlanta, GA (US)

(72) Inventor: Stuart Alan Miller, Atlanta, GA (US)

(73) Assignee: TERP CHASERS CLUB LLC, Atlanta, GA (US)

( * ) Notice: Subject to any disclaimer, the term of this patent is extended or adjusted under 35 U.S.C. 154(b) by 0 days.

(21) Appl. No.: 19/292,345

(22) Filed: Aug. 6, 2025

Related U.S. Application Data

(60) Provisional application No. 63/842,112, filed on Jul. 11, 2025.

(51) Int. Cl.

| | |
|---|---|
| ***A24F 40/20*** | (2020.01) |
| ***A24F 1/30*** | (2006.01) |
| ***A24F 40/42*** | (2020.01) |
| ***A24F 40/46*** | (2020.01) |
| ***A24F 40/485*** | (2020.01) |
| ***A24F 40/50*** | (2020.01) |

(52) U.S. Cl.
CPC ..... *A24F 40/20* (2020.01); *A24F 40/42* (2020.01); *A24F 40/46* (2020.01); *A24F 40/485* (2020.01); *A24F 40/50* (2020.01)

(58) Field of Classification Search
None
See application file for complete search history.

(56) References Cited

U.S. PATENT DOCUMENTS

| | | | | |
|---|---|---|---|---|
| 2017/0354186 | A1* | 12/2017 | Johnson | A61M 11/042 |
| 2019/0133182 | A1* | 5/2019 | Masri | F24H 3/088 |
| 2019/0174824 | A1* | 6/2019 | Neuhaus | A61M 11/042 |
| 2022/0192269 | A1* | 6/2022 | Kohbodi | A24F 40/51 |
| 2023/0218001 | A1* | 7/2023 | Jurist | G05D 23/2401 131/329 |
| 2023/0363456 | A1* | 11/2023 | Gallagher | A24F 40/53 |
| 2024/0148061 | A1* | 5/2024 | Pan | A24F 40/46 |

OTHER PUBLICATIONS

Quartz Frits Archives. Technical Glass Products. (n.d.). https://technicalglass.com/product-pages/quartz-frits/?srsltid=AfmBOorlsZyl1FYDrMohvYLdg54nsQXKQtCbE5DIVvg4yo85T3ny-2Kq (Year: 2025).*

Vices Adaptaball Kit (https://vices-oz.com/products/vices-adaptaball-kit) (Year: 2025).*

* cited by examiner

*Primary Examiner* — Philip Y Louie
*Assistant Examiner* — Nicole A Szumigalski
(74) *Attorney, Agent, or Firm* — Curatolo Sidoti & Trillis Co., LPA; Floyd Trillis, III; Salvatore A. Sidoti

(57) ABSTRACT

Aspects of the present disclosure relate to a dry herb vaporizer for use in the vaporization of substances, as well as a container for holding and heating a vaporizable product. Methods of using such a device and removably engaging such a device with a smoking device are provided. A method of heating vaporizable substances is also provided.

18 Claims, 4 Drawing Sheets

VAPORIZING DEVICE AND METHOD

TECHNICAL FIELD

The present disclosure relates to a vaporizer device for use in the vaporization of dry substances. According to illustrative embodiments, the present disclosure relates to a vaporizer device for use in the vaporization of dry herbs.

BACKGROUND

Electronic vaporizers are commonplace and are generally utilized for the purpose of aroma and/or inhalation therapy. In this regard, vaporizers heat a substance, herbs for example, such as tobacco, cannabis, lavender, chamomile, and many other types of plant material.

After the substance is heated a mist or vapor containing some aspect of the substance is released and either enjoyed as an aromatic or inhaled to obtain a physiological reaction. Vaporizers are often preferred over traditional methods of heating or smoking substances due to the reduction of harsh side effects. Some of these side effects include inhalation of tar, carbon monoxide, and other carcinogens either directly or from second hand smoke. With many states imposing smoking bans in public areas, vaporizers have become popular substitutes.

There is a need for improved vaporizers for dried plant material that provide an enhanced vaporizing experience, including vaporizers with improved quality of the vapor produced for inhalation and improved ease of use.

SUMMARY

According to a first illustrative embodiment, disclosed is a dry herb vaporizer comprising an outer housing comprising a first end, a second end, and an internal region; and an inner non-metallic housing configured to be positioned at least partially within the internal region of the outer housing and comprising a first end, a second end, and an internal region configured to contain or receive a heat retaining material.

According to a second illustrative embodiment, disclosed is a dry herb vaporizer comprising an outer housing comprising a first end, a second end, and an internal region; and an inner quartz housing configured to be positioned at least partially within the internal region of the outer metal or metal alloy housing and comprising a first end, a second end, and an internal region configured to contain or receive a heat retaining material.

According to a third illustrative embodiment, disclosed is a dry herb vaporizer comprising an outer metal or metal alloy housing comprising a first end, a second end, and an internal region; and an inner quartz housing configured to be positioned at least partially within the internal region of the outer metal or metal alloy housing and comprising a first end, a second end, and an internal region configured to contain or receive a heat retaining material.

According to a fourth illustrative embodiment, disclosed is a dry herb vaporizer comprising an outer housing comprising a first end, a second end, a first internal region, and a second internal region; an inner non-metallic housing comprising a first end having an end wall comprising one or more airflow openings, an open second end, and an internal region configured to contain or receive a heat retaining material, wherein the inner quartz housing is configured to be positioned at least partially within the first internal region of the outer housing.

According to a fifth illustrative embodiment, disclosed is a dry herb vaporizer comprising an outer housing comprising a first end, a second end, a first internal region, and a second internal region; an inner quartz housing comprising a first end having an end wall comprising one or more airflow openings, an open second end, and an internal region configured to contain or receive a heat retaining material, wherein the inner quartz housing is configured to be positioned at least partially within the first internal region of the outer housing.

According to a sixth illustrative embodiment, disclosed is a dry herb vaporizer comprising an outer metal or metal alloy housing comprising a first end, a second end, a first internal region, and a second internal region; an inner quartz housing comprising a first end having an end wall comprising one or more airflow openings, an open second end, and an internal region configured to contain or receive a heat retaining material, wherein the inner quartz housing is configured to be positioned at least partially within the first internal region of the outer housing.

According to a seventh illustrative embodiment, disclosed is a dry herb vaporizer comprising an outer housing comprising a first end, a second end, a first internal region, and a second internal region; an inner non-metallic housing comprising a first end having an end wall comprising one or more airflow openings, an open second end, and an internal region configured to contain or receive a heat retaining material, wherein the inner non-metallic housing is configured to be positioned at least partially within the first internal region of the outer housing; a cover member configured to be engaged with the second open end of the inner non-metallic housing; wherein the second internal region of the outer housing includes an internal space configured to engage a herb housing member containing dry herb material; and a handle configured to removably couple the first end of the outer housing to the handle.

According to an eighth illustrative embodiment, disclosed is a dry herb vaporizer comprising an outer housing comprising a first end, a second end, a first internal region, and a second internal region; an inner quartz housing comprising a first end having an end wall comprising one or more airflow openings, an open second end, and an internal region configured to contain or receive a heat retaining material, wherein the inner quartz housing is configured to be positioned at least partially within the first internal region of the outer housing; a cover member configured to be engaged with the second open end of the inner quartz housing; wherein the second internal region of the outer housing includes an internal space configured to engage a herb housing member containing dry herb material; and a handle configured to removably couple the first end of the outer housing to the handle.

According to a ninth illustrative embodiment, disclosed is a dry herb vaporizer comprising an outer metal or metal alloy housing comprising a first end, a second end, a first internal region, and a second internal region; an inner quartz housing comprising a first end having an end wall comprising one or more airflow openings, an open second end, and an internal region configured to contain or receive a heat retaining material, wherein the inner quartz housing is configured to be positioned at least partially within the first internal region of the outer housing; a cover member configured to be engaged with the second open end of the inner quartz housing; wherein the second internal region of the outer housing includes an internal space configured to engage a herb housing member containing dry herb material;

and a handle configured to removably couple the first end of the outer housing to the handle.

According to a tenth illustrative embodiment, disclosed is a dry herb vaporizer comprising an outer housing comprising a first end, a second end, a first internal region, and a second internal region, wherein the second internal region of the outer housing includes an internal space configured to engage a herb housing member containing dry herb material; an inner non-metallic housing comprising a first end having an end wall comprising one or more airflow openings, an open second end, and an internal region containing a heat retaining material, wherein the inner non-metallic housing is positioned at least partially within the first internal region of the outer housing; a cover member engaged with the second open end of the inner non-metallic housing; and a handle removably coupled to the first end of the outer housing to the handle.

According to an eleventh illustrative embodiment, disclosed is a dry herb vaporizer comprising an outer housing comprising a first end, a second end, a first internal region, and a second internal region, wherein the second internal region of the outer housing includes an internal space configured to engage a herb housing member containing dry herb material; an inner quartz housing comprising a first end having an end wall comprising one or more airflow openings, an open second end, and an internal region containing a heat retaining material, wherein the inner quartz housing is positioned at least partially within the first internal region of the outer housing; a cover member engaged with the second open end of the inner quartz housing; and a handle removably coupled to the first end of the outer housing to the handle.

According to a twelfth illustrative embodiment, disclosed is a dry herb vaporizer comprising an outer metal or metal alloy housing comprising a first end, a second end, a first internal region, and a second internal region, wherein the second internal region of the outer housing includes an internal space configured to engage a herb housing member containing dry herb material; an inner quartz housing comprising a first end having an end wall comprising one or more airflow openings, an open second end, and an internal region containing a heat retaining material, wherein the inner quartz housing is positioned at least partially within the first internal region of the outer housing; a cover member engaged with the second open end of the inner quartz housing; and a handle removably coupled to the first end of the outer housing to the handle.

According to a thirteenth illustrative embodiment, disclosed is a dry herb vaporizer kit comprising: an outer housing comprising a first end, a second end, and an internal region; and an inner non-metallic housing configured to be positioned at least partially within the internal region of the outer housing and comprising a first end, a second end, and an internal region configured to contain or receive a heat retaining material.

According to a fourteenth illustrative embodiment, disclosed is a dry herb vaporizer kit comprising: an outer housing comprising a first end, a second end, and an internal region; and an inner quartz housing configured to be positioned at least partially within the internal region of the outer metal or metal alloy housing and comprising a first end, a second end, and an internal region configured to contain or receive a heat retaining material.

According to a fifteenth illustrative embodiment, disclosed is a dry herb vaporizer kit comprising: an outer metal or metal alloy housing comprising a first end, a second end, and an internal region; and an inner quartz housing configured to be positioned at least partially within the internal region of the outer metal or metal alloy housing and comprising a first end, a second end, and an internal region configured to contain or receive a heat retaining material.

According to a sixteenth illustrative embodiment, disclosed is a dry herb vaporizer kit comprising: an outer housing comprising a first end, a second end, a first internal region, and a second internal region, wherein the second internal region of the outer housing includes an internal space configured to engage a herb housing member containing dry herb material; an inner non-metallic housing comprising a first end having an end wall comprising one or more airflow openings, an open second end, and an internal region configured to contain or receive a heat retaining material, wherein the inner non-metallic housing is configured to be positioned at least partially within the first internal region of the outer housing; a heat retaining material; a cover member configured to be engaged with the second open end of the inner non-metallic housing; and a handle having a coupling means configured to removably couple the first end of the outer housing to the handle.

According to a seventeenth illustrative embodiment, disclosed is a dry herb vaporizer kit comprising: an outer housing comprising a first end, a second end, a first internal region, and a second internal region, wherein the second internal region of the outer housing includes an internal space configured to engage a herb housing member containing dry herb material; an inner quartz housing comprising a first end having an end wall comprising one or more airflow openings, an open second end, and an internal region configured to contain or receive a heat retaining material, wherein the inner quartz housing is configured to be positioned at least partially within the first internal region of the outer housing; a heat retaining material; a cover member configured to be engaged with the second open end of the inner quartz housing; and a handle having a coupling means configured to removably couple the first end of the outer housing to the handle.

According to an eighteenth illustrative embodiment, disclosed is a dry herb vaporizer kit comprising: an outer metal or metal alloy housing comprising a first end, a second end, a first internal region, and a second internal region, wherein the second internal region of the outer housing includes an internal space configured to engage a herb housing member containing dry herb material; an inner quartz housing comprising a first end having an end wall comprising one or more airflow openings, an open second end, and an internal region configured to contain or receive a heat retaining material, wherein the inner quartz housing is configured to be positioned at least partially within the first internal region of the outer housing; a heat retaining material; a cover member configured to be engaged with the second open end of the inner quartz housing; and a handle having a coupling means configured to removably couple the first end of the outer housing to the handle.

According to an nineteenth illustrative embodiment, disclosed is a method of vaporizing dry herb and supplying the resulting vapor to a user, wherein the method comprises loading an internal region of an inner non-metallic housing having one or more airflow openings with heat retaining material; positioning an outer housing over at least a portion of the inner non-metallic housing; heating the heat retaining material to a temperature of about 350° F. to about 650° F.; positioning the outer housing over at least a portion of a herb housing member containing dry herb material, wherein the herb housing member is in direct contact with a smoking device; inhaling through an inhalation aperture in fluid communication with the herb housing member.

According to a twentieth illustrative embodiment, disclosed is a method of vaporizing dry herb and supplying the resulting vapor to a user, wherein the method comprises loading an internal region of an inner quartz housing having one or more airflow openings with heat retaining material; positioning an outer housing over at least a portion of the inner quartz housing; heating the heat retaining material to a temperature of about 350° F. to about 650° F.; positioning the outer housing over at least a portion of a herb housing member containing dry herb material, wherein the herb housing member is in direct contact with a smoking device; inhaling through an inhalation aperture in fluid communication with the herb housing member.

According to a twenty-first illustrative embodiment, disclosed is a method of vaporizing dry herb and supplying the resulting vapor to a user, wherein the method comprises loading an internal region of an inner quartz housing having one or more airflow openings with heat retaining material; positioning an outer metal or metal alloy housing over at least a portion of the inner quartz housing; heating the heat retaining material to a temperature of about 350° F. to about 650° F.; positioning the outer metal or metal alloy housing over at least a portion of a herb housing member containing dry herb material, wherein the herb housing member is in direct contact with a smoking device; inhaling through an inhalation aperture in fluid communication with the herb housing member.

According to a twenty-second illustrative embodiment, disclosed is a method of vaporizing dry herb and supplying the resulting vapor to a user, wherein the method comprises: loading an internal region of an inner quartz housing with heat retaining material, wherein the inner quartz housing comprises a first end having an end wall comprising one or more airflow openings, and an open second end; engaging a cover member with the second open end of the inner quartz housing; positioning the first end of the inner quartz housing at least partially within a ring member located at a second end of a handle member; positioning an outer housing over at least a portion of the inner quartz housing and removably coupling the outer housing to the ring member of the handle member; heating the heat retaining material to a temperature of about 350° F. to about 650° F.; positioning a second internal region of the outer housing over at least a portion of a herb housing member containing dry herb material, wherein the herb housing member is in direct contact with a smoking device; inhaling through an inhalation aperture in fluid communication with the herb housing member.

According to a twenty-third illustrative embodiment, disclosed is a method of vaporizing dry herb and supplying the resulting vapor to a user, wherein the method comprises: loading an internal region of an inner non-metallic housing with heat retaining material, wherein the inner non-metallic housing comprises a first end having an end wall comprising one or more airflow openings, and an open second end; engaging a cover member with the second open end of the inner non-metallic housing; positioning the first end of the inner non-metallic housing at least partially within a ring member located at a second end of a handle member; positioning an outer housing over at least a portion of the inner non-metallic housing and removably coupling the outer housing to the ring member of the handle member; heating the heat retaining material to a temperature of about 350° F. to about 650° F.; positioning a second internal region of the outer housing over at least a portion of a herb housing member containing dry herb material, wherein the herb housing member is in direct contact with a smoking device; inhaling through an inhalation aperture in fluid communication with the herb housing member.

According to a twenty-fourth illustrative embodiment, disclosed is a method of vaporizing dry herb and supplying the resulting vapor to a user, wherein the method comprises: loading an internal region of an inner quartz housing with heat retaining material, wherein the inner quartz housing comprises a first end having an end wall comprising one or more airflow openings, and an open second end; engaging a cover member with the second open end of the inner quartz housing; positioning the first end of the inner quartz housing at least partially within a ring member located at a second end of a handle member; positioning an outer metal or metal alloy housing over at least a portion of the inner quartz housing and removably coupling the outer metal or metal alloy housing to the ring member of the handle member; heating the heat retaining material to a temperature of about 350° F. to about 650° F.; positioning a second internal region of the outer metal or metal alloy housing over at least a portion of a herb housing member containing dry herb material, wherein the herb housing member is in direct contact with a smoking device; inhaling through an inhalation aperture in fluid communication with the herb housing member.

DETAILED DESCRIPTION

Figure 1:
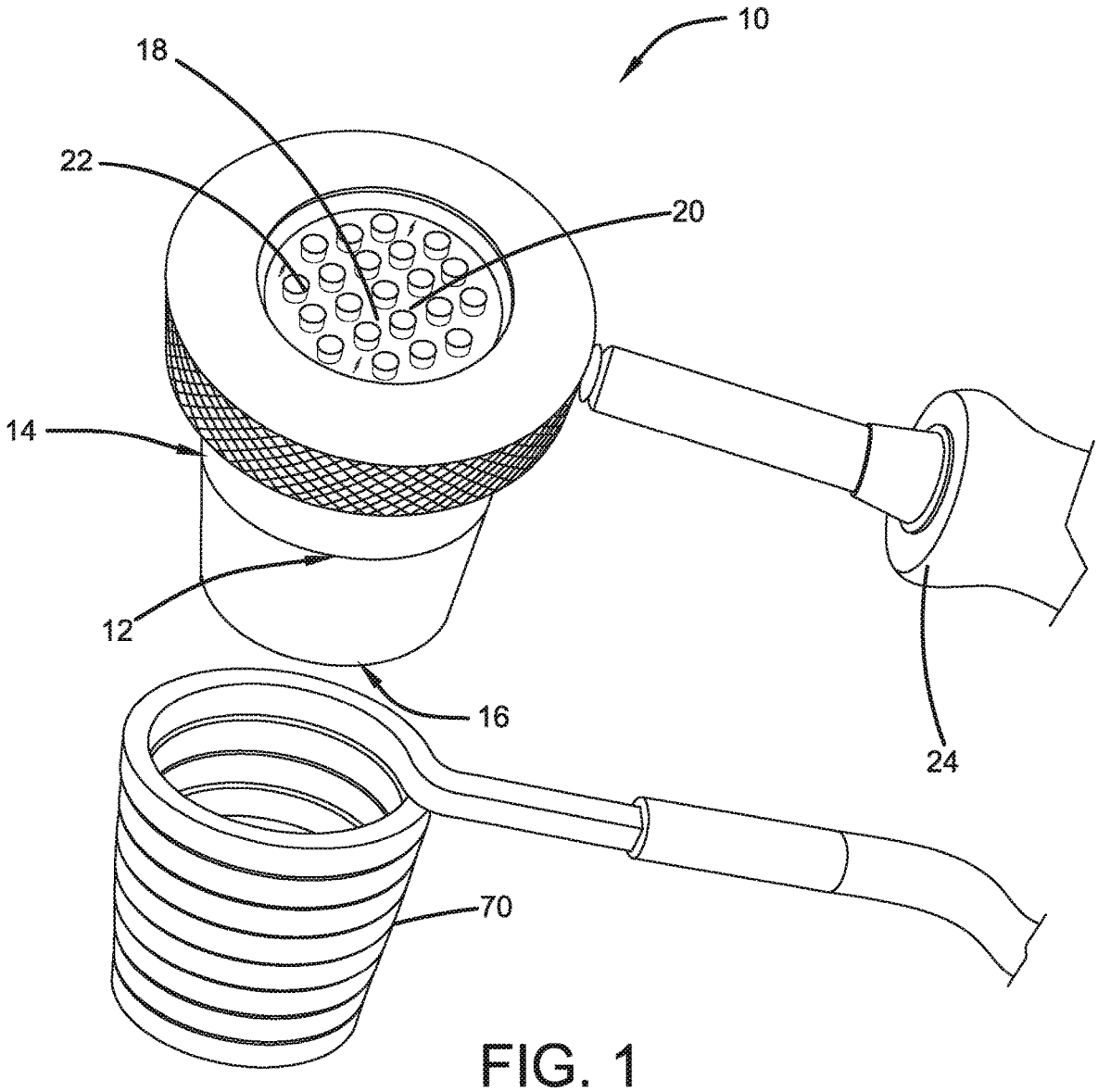
FIG. 1 is a top side perspective view of an illustrative dry herb vaporizer.

According to certain embodiments, disclosed is a dry herb vaporizer comprising an outer housing comprising a first end, a second end, a first internal region, and a second internal region; an inner quartz housing comprising a first end having an end wall comprising one or more airflow openings, an open second end, and an internal region configured to contain or receive a heat retaining material, wherein the inner quartz housing is configured to be positioned at least partially within the first internal region of the outer housing; a cover member configured to be engaged with the second open end of the inner quartz housing; wherein the second internal region of the outer housing includes an internal space configured to engage a herb housing member containing dry herb material; and a handle configured to removably couple the first end of the outer housing to the handle. Quartz, also referred to as quartz glass, fused quartz or fused silica, refers to an amorphous fused glass containing a $SiO_2$ content of about 99 to 100%. In certain embodiments, the inner housing is comprised of corundum. According to this embodiment, the inner housing may exclude quartz.

The disclosed dry herb vaporizer is configured specifically for use with "dry herb" which generally refers to dried plant material, such as crushed dried cannabis leaves, tobacco leaves, or chamomile leaves. However, other dry substances may also be used in accordance with the principles of the invention. As used herein, the terms "dry" or "dried" refer to dry herb material having a total moisture content of less than 50 wt. %, or less than 40 wt. %, or less than 30 wt. %, or less than 20 wt. %, or less than 15 wt. %, or less than 10 wt. %, based on the total weight of the dried material.

In certain embodiments, the handle of the dry herb vaporizer comprises a gripping portion. The griping portion of the handle may comprise an elongated member having first end and a second end. The handle comprises a coupling member to couple the handle to the outer housing of the vaporizing device. The coupling member of the handle member may comprise a ring member located at the second end of the handle member. The coupling ring member of the handle may be comprised of any high temperature resistant material. According to certain embodiments the ring coupling member of the handle is composed of metal or a metal alloy. According to certain embodiments, the ring coupling member of the handle is comprised of titanium metal, stainless steel metal alloy, or the like. In some embodiments, the outer housing is comprised of titanium and/or stainless steel.

The handle of the device is removably couplable to the outer housing of the device. In certain embodiments, the first end of the outer housing is externally threaded, the ring member of the handle member is internally threaded, and the first end of the outer housing is configured to be removably coupled to the ring member of the handle member by a threaded connection between the first end of the outer housing and the ring member of the handle. According to other embodiments, the ring coupling member may be engaged with the outer housing through a friction fit, snap-on engagement, and any other suitable attachments, connections, or engagements.

In certain embodiments, a heating element such as a heating coil may be incorporated with the handle of the dry herb vaporizer. In certain embodiments, the handle incorporating the heating coil is positioned around the outer surface of the of the device for heating the device. According to this illustrative embodiment, a user can grip at least partially around the outer housing, like gripping a mug. According to certain embodiments, the dry herb vaporizer comprises a non-metallic housing configured to accept and retain a heat retaining material, such as for example, a quartz housing having a first end, a second end and an internal region for accepting and retaining the heat retaining material. The quartz housing may include an end wall on one or both of the first and second ends of the housing. At least one of the first and second ends may include an integral end wall that is not removable from the body of the quartz housing. At least one of the first and second ends of the quartz housing may also include a removable end wall. Any or all of the integral end wall and removable end walls may include one or more airflow openings to permit air flow through the quartz housing. Any or all of the integral end wall and removable end walls may be a porous cover, wall, or layer. According to any of these embodiments, a heating element such as a heating coil, may be configured in shape such that the quartz housing may be located within the shape for heating. Without limitation, the quartz housing and heating element are provided substantially in the shape of an elongated cylinder. The inner circumference of the heating element may be slightly larger than the outer circumference of the quartz housing such that the quartz housing may be placed or otherwise positioned within the heating element for purposes of heating. The heating coil may be formed into any suitable shape for accommodating the outer geometry or shape of the quartz housing. For example, and only by way of illustration, an elongated heating coil may be provided in the shape of a bowl or cylinder by turning or winding the length of the heating coil in an upwardly spiral fashion such that the turns of the heating coil are successively stacked until a suitable bowl-like shape having a closed bottom, open top, and internal region for positioning the quartz housing is formed.

In certain embodiments, the outer housing comprises an internal shoulder extending inwardly from an inner surface of the outer housing and delineating the first internal region of the outer housing from the second internal region of the outer housing. In some cases, the internal shoulder comprises a continuous ring extending inwardly from the inner surface of the outer housing. In some embodiments, the internal shoulder is configured to retain the inner quartz housing within the first internal region of the outer housing.

In certain embodiments, the cover member is a porous glass or quartz layer. In some embodiments, the cover member is sintered powdered glass or fiberglass. In certain embodiments, the cover member comprises a fritted disc. According to certain embodiments, the inner non-metallic housing such as a quart housing includes a first end, a second end, and an internal region configured to accept and retain a heating retaining material. According to certain embodiments, one of the first and second ends of the inner quartz housing includes an integral end wall which cannot be removed. According to certain embodiments, none of the first and second ends of the inner quartz housing includes an integral end wall which cannot be removed. According to certain embodiments, one of the first and second ends of the inner quartz housing includes end walls that are removable. According to certain embodiments, one of the first and second ends of the inner quartz housing includes an integral end wall which cannot be removed and the other end of the first and second ends includes a removable end wall. The integral or removable end walls may include one or more airflow openings to permit the flow of air through the inner quartz housing. According to other embodiments, the integral or removal end walls may be a porous cover, membrane, layer, surface, or wall. According to certain embodiments, the first end of the inner quartz housing includes an integral end wall having a plurality of airflow openings and the second end of the inner quartz housing includes a removable porous end cover. The heat retaining material is introduced into the internal region of the inner quartz housing through the open second end and then the removable porous end cover is engaged with the inner quartz housing to seal the heat retaining material within the quartz housing.

The heat retaining material comprise a plurality of heat-retaining particles. The heat-retaining particle may be provided in any geometric shape. Without limitation suitable geometries include cone, cube, cuboid, cylinder, ellipsoid, oblong, oval, pyramid, round, rectangular, spherical, square, triangular, or any other prismatic geometry or shape. In certain embodiments, and without limitation, the heat retaining material comprises a plurality of substantially spherical beads. In certain embodiments, the plurality of substantially spherical beads are selected from corundum, borosilicate, ceramic, quartz, glass, and combinations thereof. In some cases, the corundum comprises substantially spherical bead of ruby and/or sapphire. In some cases, the substantially spherical beads have an average diameter of about 1 mm to about 4 mm. In certain embodiments, the substantially spherical beads are configured to rotate or spin inside the inner quartz housing during use, improving airflow, heat distribution, and overall vaporization.

In certain embodiments, the dry herb vaporizer is configured to operate by a wireless electrical connection for use in convection heating of the vaporizer. For the wireless convection heating, the dry herb vaporizer device is brought into contact with a heater. According to certain embodiments, a heating block is in thermal communication with the heater. The wireless dry herb vaporized is inserted at least partially into the heating block which is in thermal communication with the heater. The heater is activated and heats the dry herb vaporizer through convection heating to a temperature input into the heater by the user.

According to other embodiments, the dry herb vaporizer is configured to operate by a wired electrical connection for use in conduction heating of the vaporizer. To create a wired electrical connection for heating, a heating coil is positioned about the outer circumference of the outer housing of the dry herb vaporize device. The heating coil is in direct electrical communication with a heater. The heater is activated and heats the dry herb vaporizer through conduction heating to a temperature input into the heater by the user.

For both the wired and wireless embodiments, the heater is controlled by a proportional integral derivative (PID) controller. Without limitation, a suitable PID controller is commercially available as Crossing Technology Dual Coil Classic PID Controller.

In certain embodiments, the heat retaining material positioned in the inner quartz housing is heated to a temperature of about 350° F. to about 650° F. such that when a user inhales through a passageway in fluid communication with the herb housing member fluid enters the first end of the inner quartz housing passing the heated heat retaining material and transferring heat to the fluid and thereafter the heated fluid flows through the herb material in the herb housing member vaporizing active compounds in the herb material. In some cases, the fluid passing through the dry herb vaporizer and the herb housing member does not contact metal. According to this embodiment, the dry herb vaporizer provides a modular quartz air path extraction resulting in an enhanced vaporizing experience with improved quality of the vapor produced for inhalation. Without limitation, other suitable heating temperatures include from about 350° F. to about 625° F., or 350° F. to about 600° F. 350° F. to about 575° F., or 350° F. to about 550° F., or 350° F. to about 525° F., or 350° F. to about 500° F., or 350° F. to about 475° F., or 350° F. to about 450° F., or 350° F. to about 425° F., or 350° F. to about 400° F., or 400° F. to about 650° F., or 400° F. to about 625° F., or 400° F. to about 600° F., or 400° F. to about 575° F., or 400° F. to about 550° F., or 400° F. to about 525° F., or 400° F. to about 500° F., or 400° F. to about 475° F., or 400° F. to about 450° F., or 400° F. to about 425° F., or 500° F. to about 600° F., or 500° F. to about 575° F., or 500° F. to about 550° F., or 500° F. to about 525° F., or any other range within about 350° F. to about 650° F.

The herb housing member is in direct contact with a smoking device. The smoking device comprises an input port wherein the herb housing member is positioned and an inhalation aperture with a fluid pathway formed therebetween. In some cases, the herb housing member is glass or quartz.

Also disclosed is a dry herb vaporizer comprising an outer housing comprising a first end, a second end, a first internal region, and a second internal region, wherein the second internal region of the outer housing includes an internal space configured to engage a herb housing member containing dry herb material; an inner quartz housing comprising a first end having an end wall comprising one or more airflow openings, an open second end, and an internal region containing a heat retaining material, wherein the inner quartz housing is positioned at least partially within the first internal region of the outer housing; a cover member engaged with the second open end of the inner quartz housing; and a handle removably coupled to the first end of the outer housing to the handle.

Also disclosed is a dry herb vaporizer kit. The kit comprises an outer housing, an inner housing, an amount of heat-retaining material, optionally a handle for the vaporizer, optionally a heating means such as a heating coil and controller for the heating coil, and optionally a bowl or housing for holding dry herb. According to certain embodiments, the kit comprises an outer housing, inner quartz housing, an amount of heat-retaining material, a handle for the vaporizer, a heating means such as a heating coil and controller for the heating coil, and a bowl or housing for holding dry herb. The kit may also include end walls for the inner housing. According to certain embodiments, the kit comprises an outer housing comprising a first end, a second end, a first internal region, and a second internal region, wherein the second internal region of the outer housing includes an internal space configured to engage a herb housing member containing dry herb material; an inner quartz housing comprising a first end having an end wall comprising one or more airflow openings, an open second end, and an internal region configured to contain or receive a heat retaining material, wherein the inner quartz housing is configured to be positioned at least partially within the first internal region of the outer housing; a heat retaining material; a cover member configured to be engaged with the second open end of the inner quartz housing; and a handle having a coupling means configured to removably couple the first end of the outer housing to the handle.

Also disclosed is a method of vaporizing dry herb and supplying the resulting vapor to a user. The method comprises loading an internal region of an inner quartz housing with heat retaining material, wherein the inner quartz housing comprises a first end having an end wall comprising one or more airflow openings, and an open second end; engaging a cover member with the second open end of the inner quartz housing; positioning the first end of the inner quartz housing at least partially within a ring member located at a second end of a handle member; positioning the outer housing over at least a portion of the inner quartz housing and removably coupling the outer housing to the ring member of the handle member; heating the heat retaining material to a temperature of about 350° F. to about 600° F.; positioning a second internal region of the outer housing over a herb housing member containing dry herb material, wherein the herb housing member is in direct contact with a smoking device; inhaling fluid through an inhalation aperture in fluid communication with the herb housing member. As used herein, the term fluid refers to a gas and/or a liquid.

Also disclosed is an inner quartz housing comprising a first end having a first end wall and/or a second end having second end wall, wherein the first end wall and/or the second end wall comprises one or more airflow openings. In certain embodiments, the first end and/or the second end of the inner quartz housing comprises a porous cover layer, such as a fritted disc. According to this embodiment, the porous cover layer may be an integral component of the inner quartz housing or may be removably coupled to the first end/or second end of the inner quartz housing. As used herein, "integral component" refers to a component of a device, such as the inner quartz housing that cannot be separated from device. Integrally formed refers to two or more components that are formed into an integral component during the manufacturing stage of the components, such as the inner quartz housing and porous cover layer components. The inner quartz housing and porous cover layer may be a single piece, or alternatively, may be separate pieces. According to any of the above embodiments, the inner quartz housing comprises an internal region configured to contain or receive a heat retaining material, such as substantially spherical ruby beads.

In certain embodiments, the inner quartz housing is at least partially inserted within an outer metal housing. In some embodiments, the inner quartz housing is least partially inserted in a conduction or induction heater coil. When the herb housing member of a smoking device, such as a bowl piece, containing dry herb material is inserted into the second internal region of the outer housing all metal is removed from the air path such that all fluid passing through the dry herb vaporizer and herb housing of the smoking device does not come into contact with any metal components or metal surfaces. This fluid path provides a less harsh and more potent vapor for the user.

Also disclosed is a dry herb vaporizer comprising an outer housing comprising a first end, a second end, a first internal region, and a second internal region, wherein the second internal region of the outer housing includes an internal space configured to engage a herb housing member containing dry herb material; an inner quartz housing comprising a first end having an end wall comprising one or more airflow openings, an open second end, and an internal region containing a heat retaining material, wherein the inner quartz housing is positioned at least partially within the first internal region of the outer housing; a cover member engaged with the second open end of the inner quartz housing; and a handle removably coupled to the first end of the outer housing to the handle.

Also disclosed is an inner quartz housing comprising a first end and a second end, wherein the first end and/or the second end comprises i) an end wall comprising one or more airflow openings or ii) a porous cover layer, wherein i) or ii) are an integral part of the inner quartz housing or removably coupled to the inner quartz housing, wherein the quartz housing comprises an internal region configured to contain or receive a heat retaining material, and wherein the quartz housing is configured to be positioned at least partially within the outer metal housing.

In certain embodiments, the inner quartz housing does not comprise a threaded portion thereon.

Figure 2:
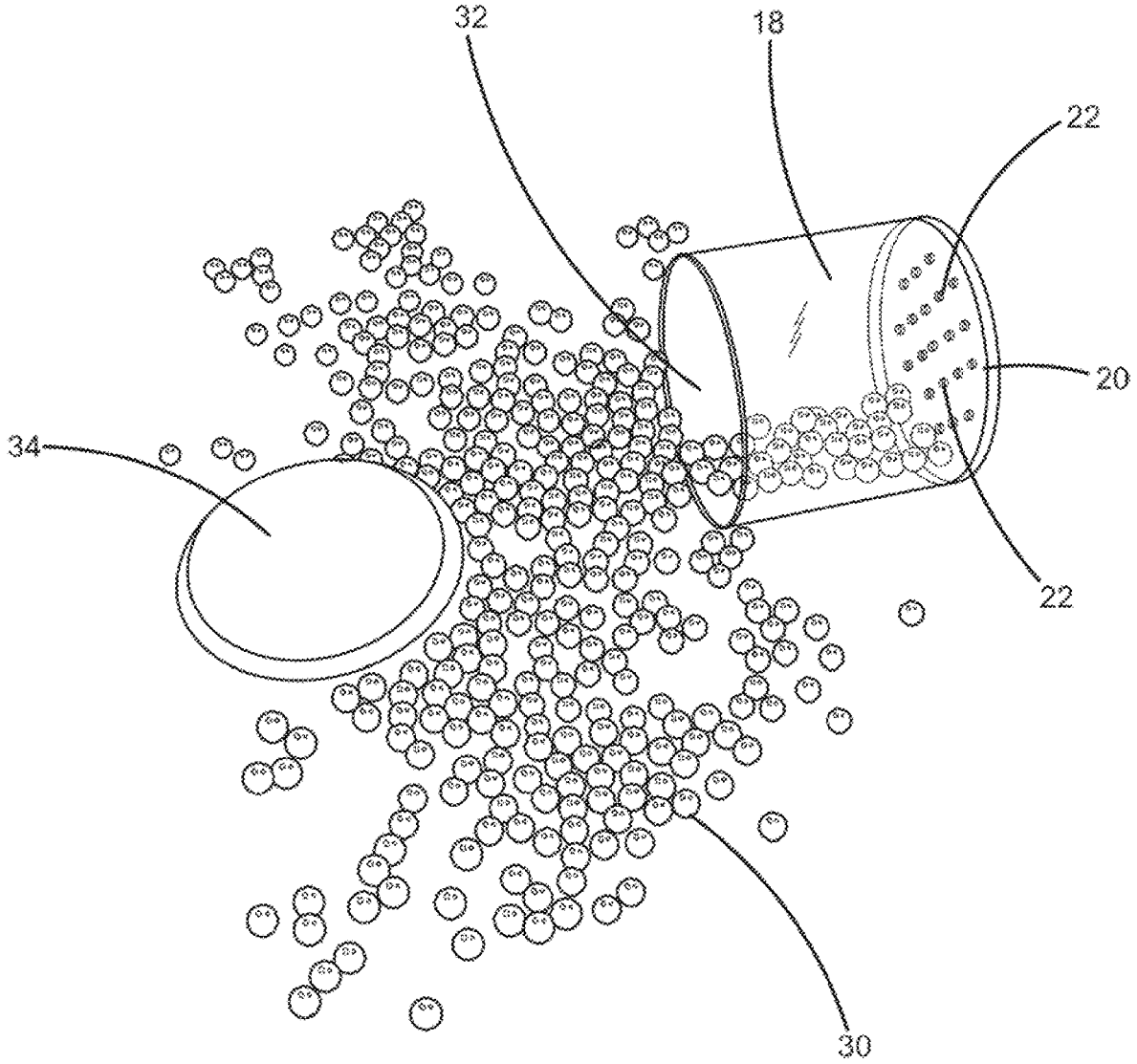
FIG. 2 is a perspective view of an illustrative inner quartz housing with spherical heat retaining beads and porous cover layer.
Figure 3:
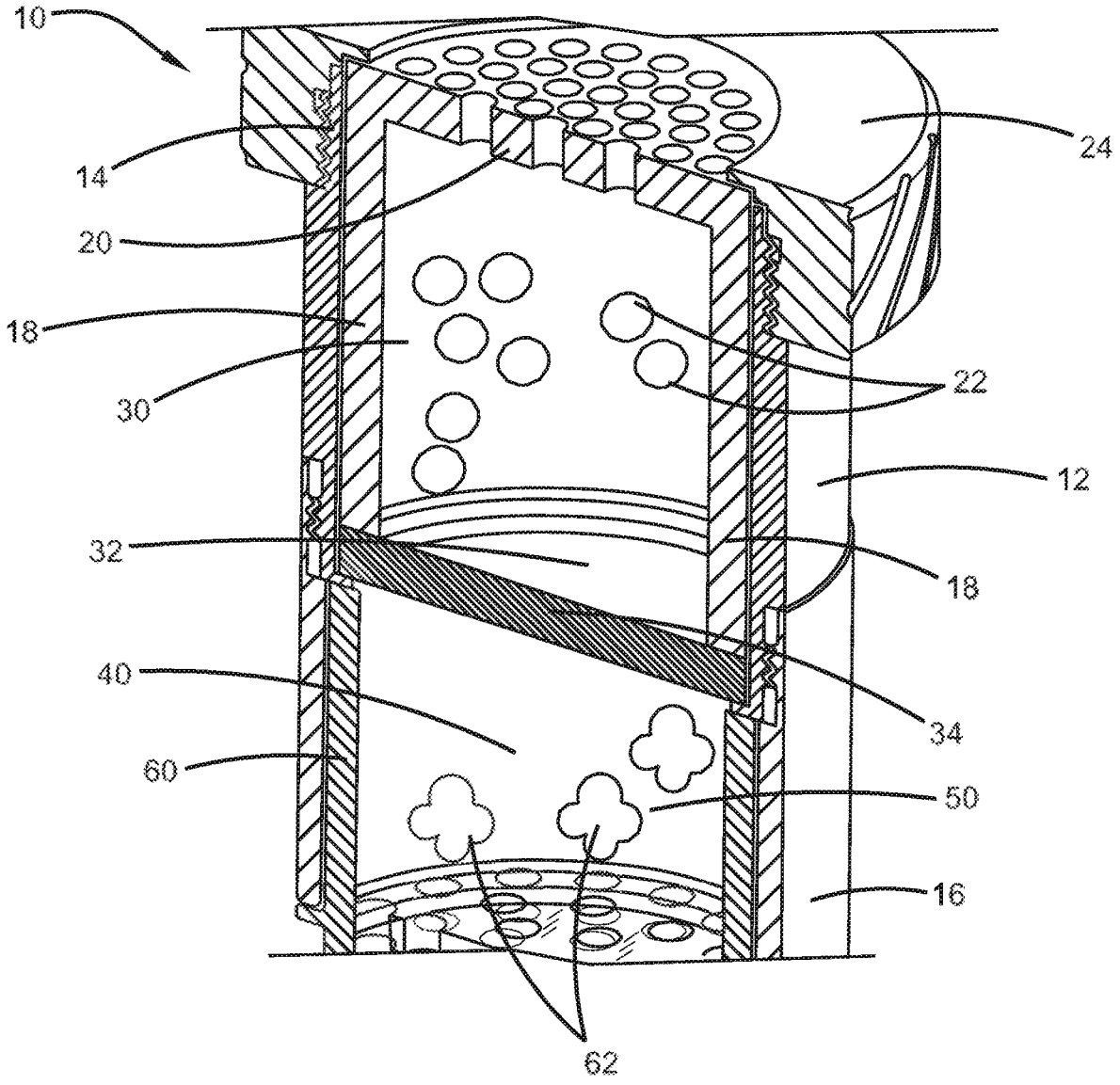
FIG. 3 is a perspective cross-sectional view of the dry herb vaporizer shown in FIG. 1.

The disclosed dry herb vaporizer is readily understood when read in conjunction with illustrative FIGS. 1-3. It should be noted that the dry herb vaporizer is not limited to any of the illustrative embodiments shown in the figures, but rather should be construed in breadth and scope in accordance with the disclosure provided herein.

FIG. 1 is a top side perspective view of an illustrative dry herb vaporizer (10) comprising: an outer housing (12) comprising a first end (14), a second end (16), a first internal region (not shown), and a second internal region (not shown); an inner quartz housing (18) comprising a first end having an end wall (20) comprising one or more airflow openings (22), an open second end (not shown), and an internal region (not shown) configured to contain or receive a heat retaining material (not shown), wherein the inner quartz housing (18) is configured to be positioned at least partially within the first internal region (not shown) of the outer housing (12); a cover member (not shown) configured to be engaged with the second open end (not shown) of the inner quartz housing (18); wherein the second internal region (not shown) of the outer housing (12) includes an internal space configured to engage a herb housing member (not shown) containing dry herb material; inner quartz housing (18) is configured to be at least partially positioned within a conduction or induction heater coil (70); and a handle (24) configured to be removably coupled to the first end (14) of the outer housing (12).

FIG. 2 is a perspective view of an illustrative inner quartz housing (18) with spherical heat retaining beads (30) and porous cover layer (34). Inner quartz housing (18) includes a first end having a first end wall (20). First end wall (20) includes a plurality of airflow openings (22). Inner quartz housing (18) has an open second end (32) opposite the first end wall (20). Open second end (32) of inner quartz housing (18) is configured to permit filling of an internal region of housing (18) with a plurality of discrete particles (30) of heat retaining material, such as substantially spherical ruby beads. Inner quartz housing (18) also includes cover member (34) configured to be engaged to, or attached, or connected with, the second open end (32) of housing (18) to retain the heat retaining material (30) within the internal region of the housing (18).

FIG. 3 is perspective cross-sectional view of the dry herb vaporizer shown in FIG. 1. Dry herb vaporizer assembly (10) includes an outer metal housing (12). Outer metal housing (12) includes a first internal region (14) and a second internal region (16) that define internal open region (40) of the housing (12). The device (10) includes an inner quartz housing (18) configured to be inserted at least partially within the outer housing (12) and to contain or receive a heat retaining material (30). Inner quartz housing (18) is positioned within the first internal region (14) of the outer housing (12). The inner quartz housing (18) is positioned adjacent the inner wall surface of the outer metal housing (12) such that the outer surface of the inner quartz housing (18) is in adjacent contact with the inner surface of the outer metal housing (12). The inner quartz housing (18) includes an open-ended portion (32) configured to receive a cover member (34) and a first end portion (20) comprising one or more airflow openings (22). The second internal region (16) of the outer metal housing (12) includes an internal space (50) adjacent to the open end portion (32) of the inner quartz housing (18) configured to receive a herb housing member (60) containing dry herb material (62). The coupling ring member (24) of the handle of the device is removably connected to the first end (14) of the outer housing (12).

Figure 4:
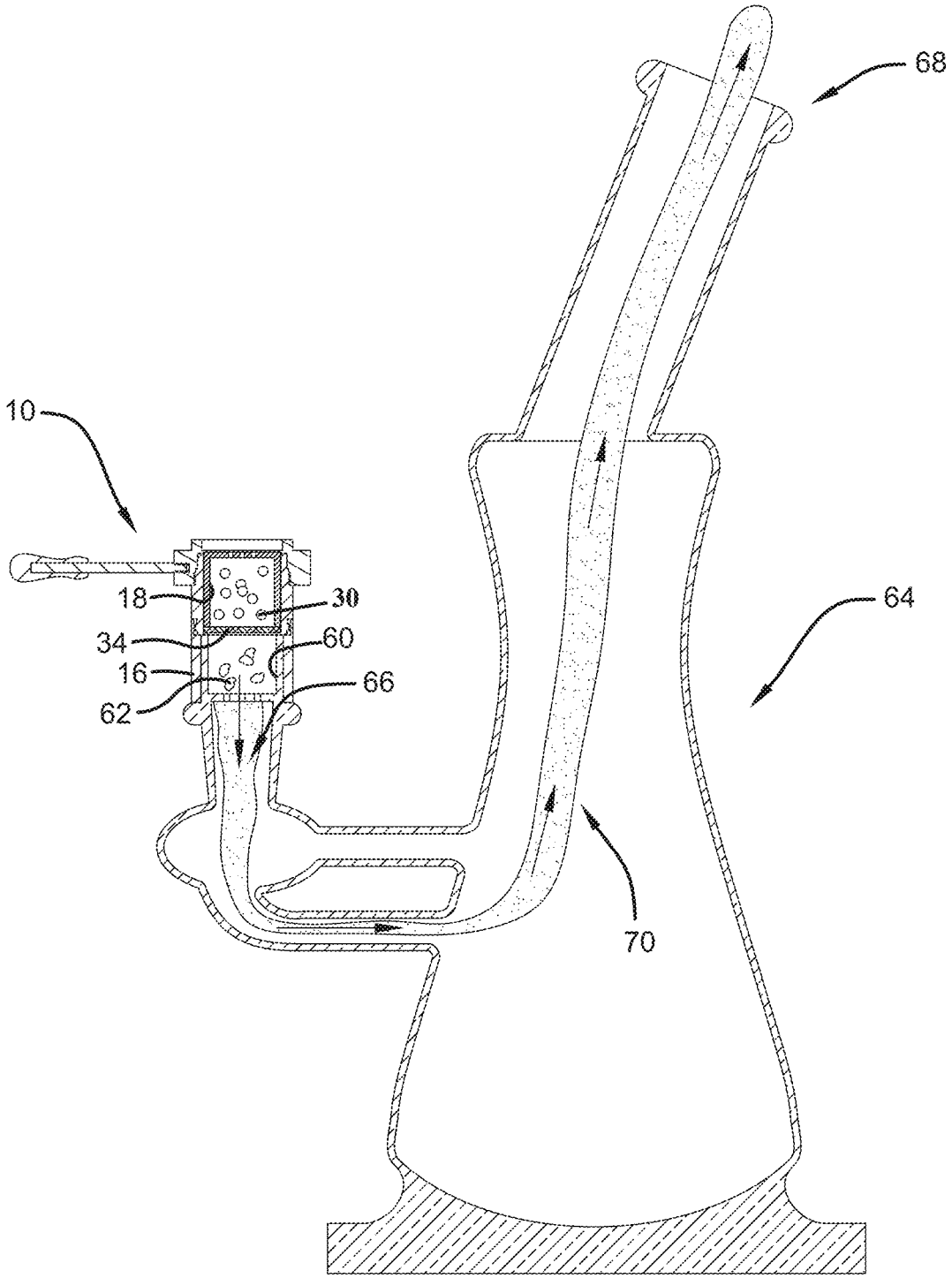

FIG. 4 is a perspective view of dry herb vaporizer (10) shown in FIG. 3 engaging herb housing member (60) containing dry herb material (62), wherein dry herb vaporizer (10) comprises inner quartz housing (18) with spherical heat retaining beads (30) therein and cover layer (34), wherein herb housing member (60) is in direct contact with smoking device (64), wherein smoking device (64) has input port (66) and inhalation aperture (68) with fluid pathway formed therebetween (70).

While the dry herb vaporizer has been disclosed according to certain embodiments, it is to be understood that other similar embodiments may be used or modifications and additions may be made to the described embodiments for performing the same function. Furthermore, the various illustrative embodiments may be combined to produce the desired results. Therefore, the present disclosure should not be limited to any single embodiment.

As used in this specification, the terms "comprises," "comprising," "contains," "containing," "includes," "including," "has," or "having," are all open-ended expressions and are intended to cover apparatus, compositions, methods, processes, products, or systems that comprise a recited list of components, elements, and features, and any and all additional components, elements and features that are not expressly recited. The terms "includes," "including," "has," or "having" are not intended to have a more narrow construction, interpretation, or meaning than the terms "comprises" or "comprising."

In the present disclosure, the term "substantially" refers to a degree of deviation that is sufficiently small so as to not measurably detract from the identified property or function or circumstance and/or refer to slight variations within normal manufacturing tolerances.

As used in the present specification, the term "or" refers to an inclusive "or" and not to an exclusive "or". For example, the phrase "A or B" is satisfied by any one of the following: A is present and B is not present, A is not present and B is present, and both A and B are present.

As used in the present specification, "a" or "an" is employed to describe components, elements, features and method/process steps of various illustrative embodiments disclosed herein. The use of "a" or "an" should be interpreted to include one or more than one.

As used in the present specification, any of the terms "illustratively," "preferably," "commonly," and "typically" are not intended to, and do not, limit the scope of the claimed embodiments, or to imply that certain features are critical, essential, important, or required to the structure or function of the claimed composition, beverage product or methods. Rather, these terms are merely intended to identify particular aspects of an embodiment or to emphasize alternative or additional features that may or may not be utilized in a particular embodiment.

The invention claimed is:

1. A dry herb vaporizer comprising:

an outer housing comprising a first end, a second end, a first internal region, and a second internal region;

an inner quartz and/or corundum housing comprising a first end having an end wall comprising one or more airflow openings, an open second end, and an internal region configured to contain or receive a heat retaining material, wherein the inner quartz and/or corundum housing is configured to be positioned at least partially within the first internal region of the outer housing, and wherein the inner quartz and/or corundum housing is configured to be positioned at least partially within a conduction or induction heater coil;

a cover member configured to be engaged with the open second end of the inner quartz and/or corundum housing;

wherein the second internal region of the outer housing includes an internal space configured to engage an herb housing member containing dry herb material;

wherein the fluid passing through the dry herb vaporizer and the herb housing member does not contact metal; and a handle configured to removably couple to the first end of the outer housing.

2. The dry herb vaporizer of claim 1, wherein the handle comprises an elongated member comprising a first end and a second end and a coupling member of the handle member comprises a ring member located at the second end of the handle member.

3. The dry herb vaporizer of claim 2, wherein the first end of the outer housing is externally threaded, the ring member of the handle member is internally threaded, and the first end of the outer housing is configured to be removably coupled to the ring member of the handle member by a threaded connection.

4. The dry herb vaporizer of claim 1, wherein the outer housing comprises an internal shoulder extending inwardly from an inner surface of the outer housing and delineating the first internal region of the outer housing from the second internal region of the outer housing.

5. The dry herb vaporizer of claim 4, wherein the internal shoulder comprises a continuous ring extending inwardly from the inner surface of the outer housing.

6. The dry herb vaporizer of claim 5, wherein the internal shoulder is configured to retain the inner quartz and/or corundum housing within the first internal region of the outer housing.

7. The dry herb vaporizer of claim 1, wherein the cover member is a porous quartz frit.

8. The dry herb vaporizer of claim 7, wherein the porous quartz frit is sintered, crushed quartz glass comprising a binder.

9. The dry herb vaporizer of claim 1, wherein the heat retaining material comprises a plurality of particles having the same or different shape.

10. The dry herb vaporizer assembly of claim 9, wherein the plurality of substantially spherical beads are selected from the group consisting of corundum, borosilicate, ceramic, quartz, and combinations thereof.

11. The dry herb vaporizer of claim 10, wherein the substantially spherical beads have an average diameter of about 1 mm to about 4 mm.

12. The dry herb vaporizer of claim 1, wherein the herb housing member is glass or quartz.

13. The dry herb vaporizer of claim 1, wherein the vaporizer is configured to be heated by a wired or wireless electrical connection.

14. The dry herb vaporizer of claim 1, wherein the vaporizer is in electrical communication with a proportional-integral-derivative (PID) controller.

15. The dry herb vaporizer of claim 1, wherein the heat retaining material positioned in the inner quartz and/or corundum housing is configured to be heated to a temperature of about 350° F. to about 650° F. such that when a user inhales through a passageway in fluid communication with the herb housing member fluid enters the first end of the inner quartz and/or corundum housing passing the heated heat retaining material and transferring heat to the fluid and thereafter the heated fluid flows through the herb material in the herb housing member vaporizing active compounds in the herb material.

16. The dry herb vaporizer of claim 1, wherein the herb housing member is in direct contact with a smoking device.

17. The dry herb vaporizer of claim 16, wherein the smoking device comprises an input port wherein the herb housing member is positioned and an inhalation aperture with a fluid pathway formed therebetween.

18. A method of vaporizing dry herb and supplying the resulting vapor to a user using the dry herb vaporizer of claim 1, wherein the method comprises:

loading the internal region of the inner quartz and/or corundum housing with a heat retaining material;

engaging the cover member with the second open end of the inner quartz and/or corundum housing;

positioning the first end of the inner quartz and/or corundum housing at least partially within a ring member located at a second end of the handle member;

positioning the outer housing over at least a portion of the inner quartz and/or corundum housing and removably coupling the outer housing to the ring member of the handle member;

heating the heat retaining material to a temperature of about 350° F. to about 500° F.;

positioning the second internal region of the outer housing over the herb housing member containing dry herb material, wherein the herb housing member is in direct contact with a smoking device; and inhaling fluid through an inhalation aperture in fluid communication with the herb housing member.

* * * * *